US007540814B2

(12) United States Patent
Dilling

(10) Patent No.: US 7,540,814 B2
(45) Date of Patent: Jun. 2, 2009

(54) COLLAPSIBLE BALL GAME GOAL

(75) Inventor: Jan B. Dilling, Isle of Palms, SC (US)

(73) Assignee: Socci Sport, LLC, Mt. Pleasant, SC (US)

( * ) Notice: Subject to any disclaimer, the term of this patent is extended or adjusted under 35 U.S.C. 154(b) by 343 days.

(21) Appl. No.: 11/352,509

(22) Filed: Feb. 10, 2006

(65) Prior Publication Data

US 2007/0187897 A1 Aug. 16, 2007

(51) Int. Cl.
*A63B 69/00* (2006.01)

(52) U.S. Cl. ..... 473/478; 473/476

(58) Field of Classification Search ..... 473/476, 473/459, 470, 478
See application file for complete search history.

(56) References Cited

U.S. PATENT DOCUMENTS

| | | | | |
|---|---|---|---|---|
| 1,112,075 | A | 9/1914 | Lush | |
| 3,794,318 | A | 2/1974 | Holmes | |
| 4,157,801 | A * | 6/1979 | Elmer | 248/97 |
| 4,335,881 | A | 6/1982 | Warehime | |
| D277,884 | S | 3/1985 | Offutt | |
| 4,706,409 | A | 11/1987 | Downing | |
| 5,243,781 | A | 9/1993 | Carter | |
| 5,332,230 | A | 7/1994 | Benedict | |
| 5,346,228 | A | 9/1994 | Offutt | |
| 5,433,434 | A | 7/1995 | Helmetsie | |
| 5,524,881 | A | 6/1996 | Edward | |
| 5,655,776 | A | 8/1997 | Kaulfuerst | |
| 5,810,679 | A | 9/1998 | Yoakum | |
| 6,142,890 | A | 11/2000 | Craig | |
| 6,287,226 | B1 | 9/2001 | Dilling | |
| 6,579,197 | B2 | 6/2003 | Benoit | |
| 6,595,879 | B1 | 7/2003 | Robbins | |
| 6,629,899 | B2 | 10/2003 | Chauvet et al. | |
| 6,736,740 | B2 | 5/2004 | Zheng | |

(Continued)

FOREIGN PATENT DOCUMENTS

| | | |
|---|---|---|
| EP | 1614452 A1 | 8/2005 |

OTHER PUBLICATIONS

Webpage download, 2004, http://web.archive.org/web/20040605230031/http://socci.net,3 pages.*

(Continued)

*Primary Examiner*—Gene Kim
*Assistant Examiner*—M Chambers
(74) *Attorney, Agent, or Firm*—Harleston Law Firm, LLC

(57) ABSTRACT

A goal for a collapsible, three-dimensional game includes: (a) at least two generally ring-shaped, openable hoops, each of the hoops being openable, closable, and coupleable at a hoop coupling of each hoop, the hoops including at least three post connecting mechanisms; (b) at least three detachable posts of substantially equal length, the posts being removably connectable to one of the post connecting mechanisms on the hoops; (c) a substantially flexible net affixed to an upper one of the hoops; and (d) a detachable net holding mechanism attachable to the post connecting mechanisms on each post; wherein, when the goal is in an open, erect position: a lower one of the hoops rests on the playing surface, the upper hoop being substantially parallel to and spaced apart from the lower one of the hoops, the net extending downwardly between the substantially horizontally oriented hoops.

18 Claims, 9 Drawing Sheets

U.S. PATENT DOCUMENTS

| | | | |
|---|---|---|---|
| 6,849,010 | B1 | 2/2005 | Valdeus, Jr. |
| 6,979,274 | B1 | 12/2005 | Raber |
| 2002/0022540 | A1 | 2/2002 | Slomski et al. |
| 2002/0183128 | A1 | 12/2002 | Cho |
| 2003/0025272 | A1 | 2/2003 | Billig et al. |
| 2003/0168360 | A1 | 9/2003 | Zheng |
| 2004/0102260 | A1 | 5/2004 | Chia |
| 2004/0214666 | A1 | 10/2004 | Dilling |
| 2005/0054464 | A1 | 3/2005 | Bryant, Jr. et al. |
| 2005/0113192 | A1 | 5/2005 | Seaman |
| 2005/0275168 | A1 | 12/2005 | Kegevic et al. |

OTHER PUBLICATIONS

Socci Sport, LLC, Socci Sport website, www.socci.net, Charleston, South Carolina, United States.

International Search Report and Written Opinion of the International Searching Authority in International Application No. PCT/US2007/002627.

"Yani Dilling Is a Game Boy", skirt magazine, Jun. 2008, p. 48, skirt, Charleston, SC.

* cited by examiner

COLLAPSIBLE BALL GAME GOAL

BACKGROUND OF THE INVENTION

1. Technical Field

The present invention relates to a collapsible ball game goal, more particularly a collapsible, portable, three-dimensional netted ball game goal for playing (or practicing) a game with a ball, the erect game goal having at least three generally vertical adjacent scoring surfaces facing outwardly in three different directions, and a central scoring basket with an upper hoop of the goal defining the basket's generally circular upper periphery, and the three scoring surfaces defining the triangular-shaped base of the scoring basket.

2. Background Information

In general, open-field team ball sports, such as soccer, football, hockey, lacrosse, and basketball, are played by two opposing teams on an open, generally rectangular playing field having two single-plane goals or baskets located on opposite sides of the field. This creates an opposite-opposing power scheme. Players attempt to advance a game ball, puck, or the like across the playing field and into the opposing team's goal or basket in order to score points, the object being to score more points than the opposing team in an allotted time frame.

A new sport, Socci, has been invented, which differs from open-field team ball sports as herein described. The sport of Socci is played by two teams of players on an elliptical field of play divided into equal halves by a midfield line. Each half-oval side of the field has at its approximate center a three-dimensional goal according to the present invention. The collapsible, portable goal of the present invention has at least three generally vertical and planar adjacent scoring surfaces, each being demarcated by net, and at least one, and preferably only one, generally horizontal basket.

In contrast to other open-field team ball sports, which have a solitary goal into which the ball must be played in order to score, the sport of Socci has multiple scoring surfaces, which affords players more scoring opportunities. This creates a central-opposing power scheme, rather than the opposite-opposing power scheme of traditional open-field team ball sports. Additionally, the central-opposing power scheme of the present invention has both the generally vertically-oriented goals and a generally horizontally oriented goal basket, and a lower ratio of players per goal, thereby decreasing crowding and further increasing scoring opportunities.

Also, the present invention encompasses a multi-faceted goal structure with at least four separate and distinct scoring planes, and the total square foot area of all three scoring planes is comparable to the scoring area provided by a single conventionally-sized goal. This allows the opposing goals in Socci to be positioned at closer proximity to each other without undesirably diminishing the challenge of scoring.

Furthermore, when oriented in the manner herein described, the multifaceted goals of the present invention each have: two forward facing, adjacent goal surfaces that are accessible from the center and sides of the field; a rear facing goal surface that is accessible only from the back of the field; and a generally horizontal basket that is accessible from any position on the field. When the goal is erect and in position, one of the forward facing scoring surfaces 29 faces the forward left side of the field and the other forward facing scoring surface 29 faces a forward right side of the playing field. Since the game rules permit the ball to be hit into any of the generally vertical goal planar scoring surfaces 29 and the generally horizontal scoring basket 27 from any point on the playing field, an abundance of scoring opportunities is provided.

Although conventional playing fields are rectangular in shape, the foot-juggling sport of Socci is preferably played on an oval-shaped playing field. Unlike a rectangular-shaped field, an oval-shaped field has no dead corners, and promotes the circulation of players, especially around the three-dimensional goal of the present invention. Socci goals are small and placed relatively close together on the field (preferably less than about 50 feet apart), so the game can be played in a limited amount of space by young or old.

Consistent with the degree of difficulty represented by each goal surface, striking the more accessible forward facing goal planar surfaces counts one point, while striking the less accessible and more risky opposite facing goal planar surfaces counts two points. In the latter case, the Socci player must advance behind the opposing team's goal with the ball and risk shooting it toward or into a team's own goal. Although the goals are accessible from anywhere on the field, the Socci ball must be either lobbed, or the ball must be kicked into the basket in order to score. Lobbing the ball into the basket requires that the ball be kicked into the air in order to fall into the target basket. Kicking the ball into the basket requires greater skill and dexterity. Therefore, and in order to further promote finesse over force, hitting the basket counts three points.

Although the specific goal structure and power scheme described herein are unique to the new sport of Socci, the goal of the present invention can be used to play many other sports and games, as well as training for existing sports. For instance, a similarly-shaped goal structure could be used to play a three-dimensional soccer alternative, "Socci soccer." Similarly, a version of the goal described herein can be used to play "Socci handball", "Socci-hockey," or "Socci Frisbee." The goal of the present invention conveys the advantages described herein to those games, too. Also, the goal of the present invention can be used to practice skills for this or other open-field sports.

BRIEF SUMMARY OF THE INVENTION

The present invention is a collapsible, portable, three-dimensional netted ball game goal for playing (includes practicing) a game with a ball. The present goal comprises: (a) at least two generally ring-shaped, openable hoops having substantially the same diameter as one another, each of the hoops comprising at least one hoop coupling, each of the hoops being openable and closable at the hoop coupling, the hoops comprising at least three post connecting mechanisms; (b) at least three detachable posts of substantially equal length, opposite ends of each of the posts being removably connectable to one of the post connecting mechanisms on the hoops; (c) a length of substantially flexible net extending between the hoops and between the posts, the net being affixed to an upper one of the hoops, but not to the posts; and (d) a detachable net holding mechanism attachable to the post connecting mechanisms at the opposite ends of each post for holding a portion of the net against that post.

In the open, erect position, the goal is suitable for use while playing the game of Socci or another open field ball game utilizing a game ball that is kicked or thrown at the goal. The goal of the present invention is also useful for training and practicing Socci or other ball games. The sturdy netted goal provides four distinct outside scoring surfaces. The game goal has at least three generally vertical adjacent scoring surfaces facing in three different directions, and at least one circular, generally horizontal scoring basket at the top of the goal. The upper hoop defines the generally circular upper periphery of a scoring basket at the top of the erect goal and adjacent the planar scoring surfaces. Thus, a goal can conceivable be scored from the back, front, sides, and top of the goal. The sides of the generally triangular-shaped base of the scoring basket are formed by the scoring surfaces.

The goal of the present invention is lightweight and can easily be carried when it is in the collapsed position, yet it is sturdy when it is in the open, erect position. One or more collapsed goals are easy to transport in a back seat or trunk of a vehicle, for example. When the present goal is in the collapsed position, it can be inserted in a carry bag and hand carried by an adult or child. The lightweight goal of the present invention is also easy to move around the field, for example, when it is in the open, erect position. The goal in the open position does not collapse when it is struck by a kicked or thrown game or practice ball. Even though the goal is compact, it has a surprisingly large total scoring surface. Scoring into this variety of surfaces requires strategy and an unusual variety of athletic skills, such as finesse, agility, speed, coordination, dexterity, and endurance.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
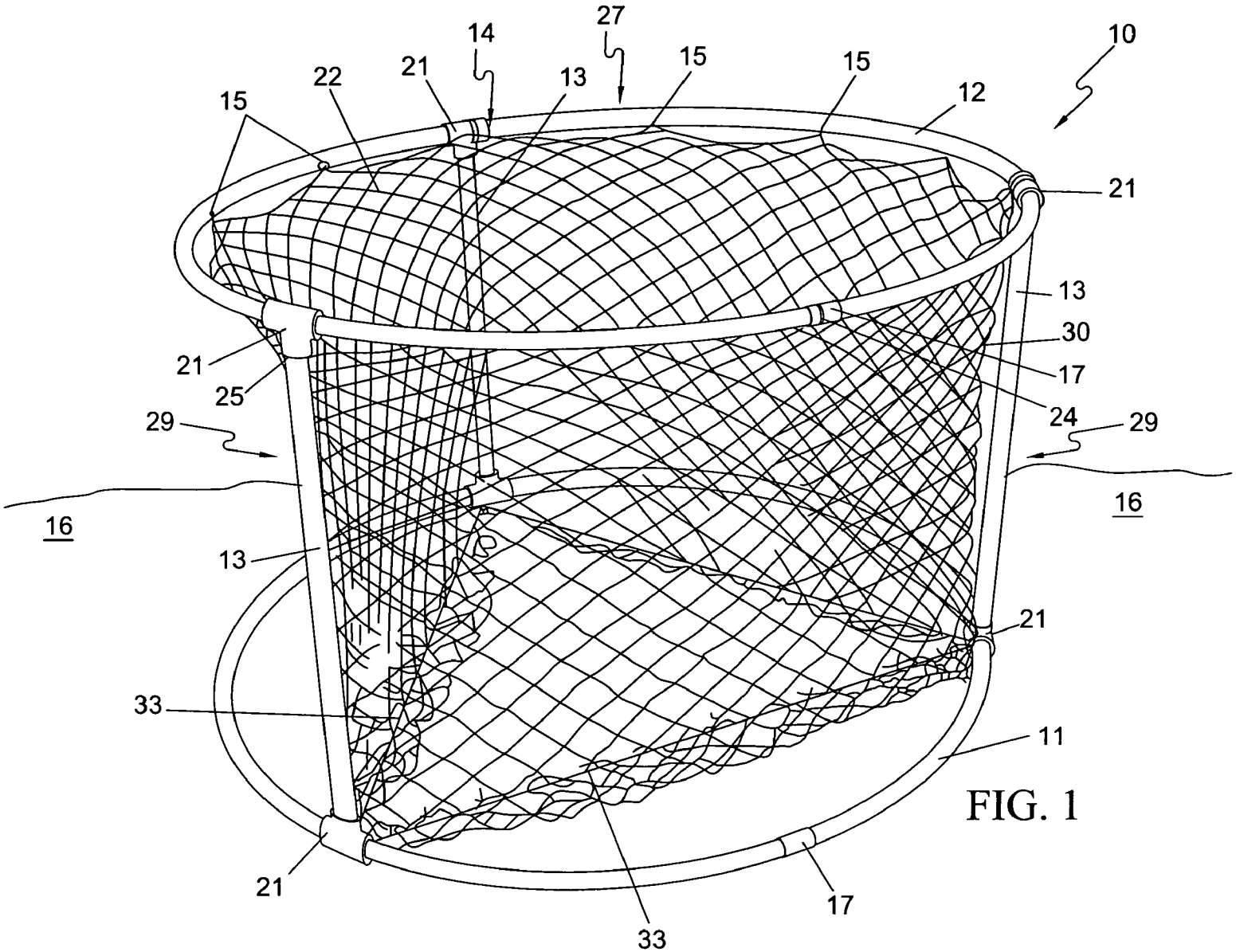
FIG. 1 is a perspective view of a collapsible game goal according to the present invention, shown in an open, erect position.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Referring first to FIG. 1, a collapsible, portable, three dimensional game goal 10 comprises: (a) at least two generally ring-shaped, openable, upper and lower hoops 11, 12 having substantially the same diameter as one another, the hoops 11, 12 being coupleable to one another at the hoop coupling 17; (b) at least three detachable posts 13 of substantially equal length; (c) a length of substantially flexible net 14 extending between the hoops 11, 12 and between the posts 13, the net being affixed to the upper hoop 12, but not to the posts 13; and (d) a detachable net holding mechanism 30 attachable to the post connecting mechanisms 21 at the opposite ends of each post 13 for holding an adjacent portion of the net 14 against that post 13. Each of the hoops 11, 12 includes at least one hoop coupling 17. Each of the hoops 11, 12 can be opened at the hoop coupling 17. The hoops 11, 12 include at least three post connecting mechanisms 21. The ends of each post 13 are removably connectable to the post connecting mechanisms 21 on the lower ("first") and upper ("second") hoops 11, 12.

Figure 7:
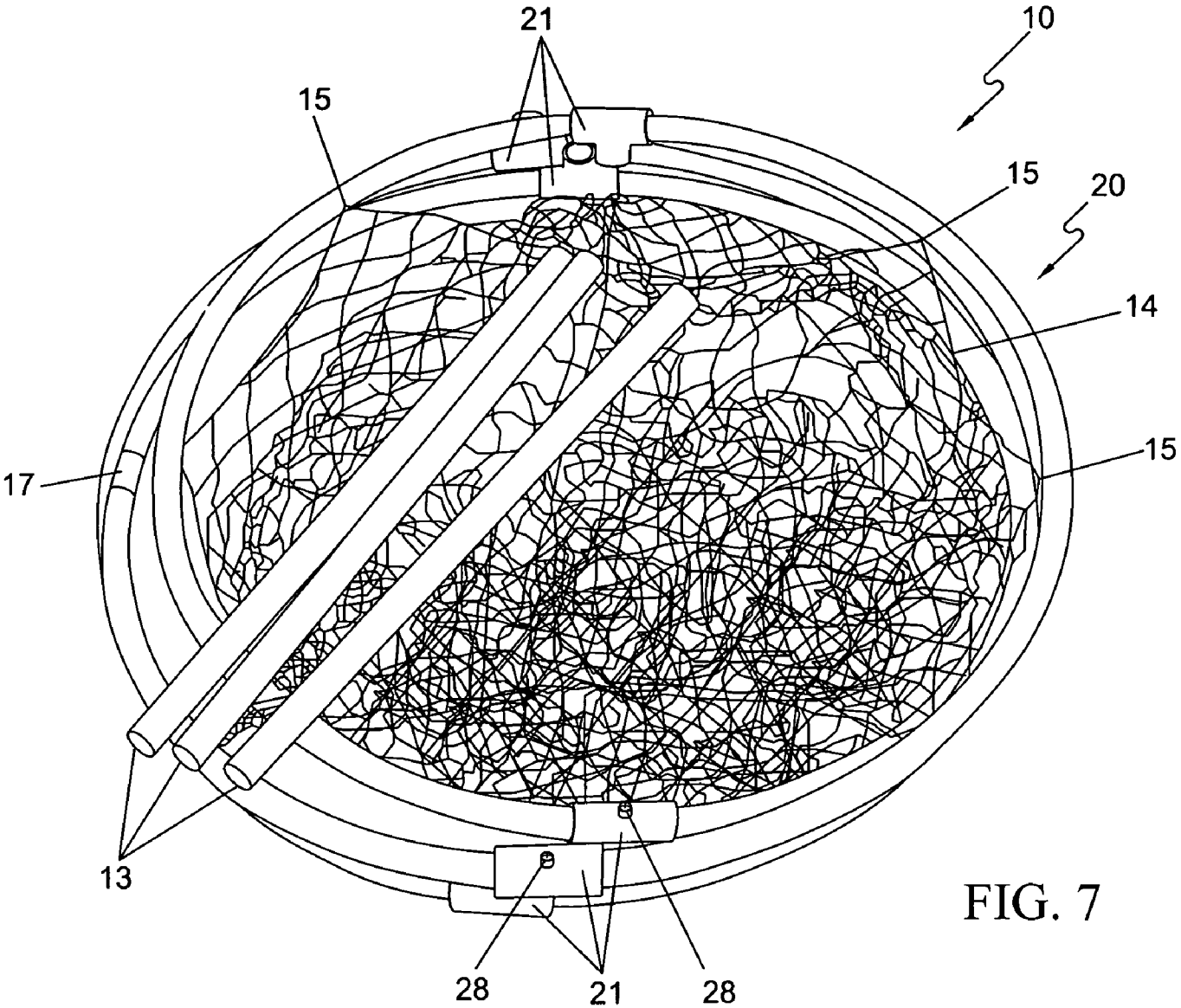
FIG. 7 is a perspective view of a game goal according to the present invention, shown in a collapsed position.

The game goal 10 has two positions for use: an open, erect, ready for use position as shown in FIG. 1, and a closed, collapsed position for transport and storage, as shown in FIG. 7. In the erect, standing position, the goal 10 is suitable for use while playing the game of Socci or another open field ball game utilizing a game ball that is kicked or thrown at the goal. The goal of the present invention is also useful for training and practicing Socci or other ball games.

When the goal 10 is in an open, erect position, as seen in FIG. 1, when the goal is in an open, erect position: the lower hoop 11 rests on the playing surface, the upper hoop 12 is substantially parallel to and spaced apart from the lower hoop 11, and the net 14 extends downwardly between the substantially horizontally oriented hoops 11, 12. Also, when the goal 10 is in an open, erect position, the posts 13 are spaced apart and extend substantially vertically between the two hoops 11, 12, and the posts 13 and net 14 define at least three adjacent, substantially vertical scoring surfaces 29, each scoring surface facing in a different direction on the playing field. Lastly, the upper hoop 12 defines the generally circular upper periphery of a scoring basket 27 at the top of the erect goal 10 and adjacent the planar scoring surfaces 29. The sides of the generally triangular-shaped base of the scoring basket 27 are formed by the scoring surfaces. The triangular-shaped base of the scoring basket, which contacts the playing surface as seen in FIG. 1, is advantageous in that it and the flexible net 14 discourage the game ball from bouncing out during play. The net 14 is preferably attached to the upper hoop 12 at a number of net attachment points 15. The bottom portion of the net 14 is preferably not affixed to the bottom hoop 11.

In its collapsed position, the lightweight goal 10 can be carried in a carry bag, for example, to the field by an adult or child, or to a vehicle for easy transport. The length of the posts 13 preferably does not exceed the diameter of the hoops 11, 12, so the carry bag (not shown) need not substantially exceed the diameter of the hoops, and so that the goal is an appropriate height during play. As shown in FIG. 7, the three posts 13 are preferably placed on top of the collapsed hoop assembly 20 and the net 14 in the carry bag. The collapsed hoop assembly 20 is seen without the net for clarity in FIG. 5. In the erect position, the goal 10 is preferably between about three and four feet high, and about three and four feet wide. Thus, the hoops 11, 12 preferably have a diameter of between about three and four feet. Since both hoops 11, 12 are generally circular in shape, the goal 10 in its erect position can be laid on its side and rolled from one place on the field to another, if desired.

When the goal 10 is in the open, erect position, the hoops are substantially horizontally oriented, with the lower hoop 11 resting on the playing surface 16, as seen in FIG. 1. The lower hoop 11 is substantially parallel to, and spaced apart from, the upper hoop 12 directly above it. The hoops 11, 12 are connected to one another by the three posts 13, which are generally vertically oriented when the goal 10 is in the erect position. The posts 13 are spaced apart from one another along the circumferences of the hoops 11, 12. The posts 13 are preferably the same size as one another. Preferably, the ring-shaped hoops 11, 12 are the same size as one another.

Figure 2:
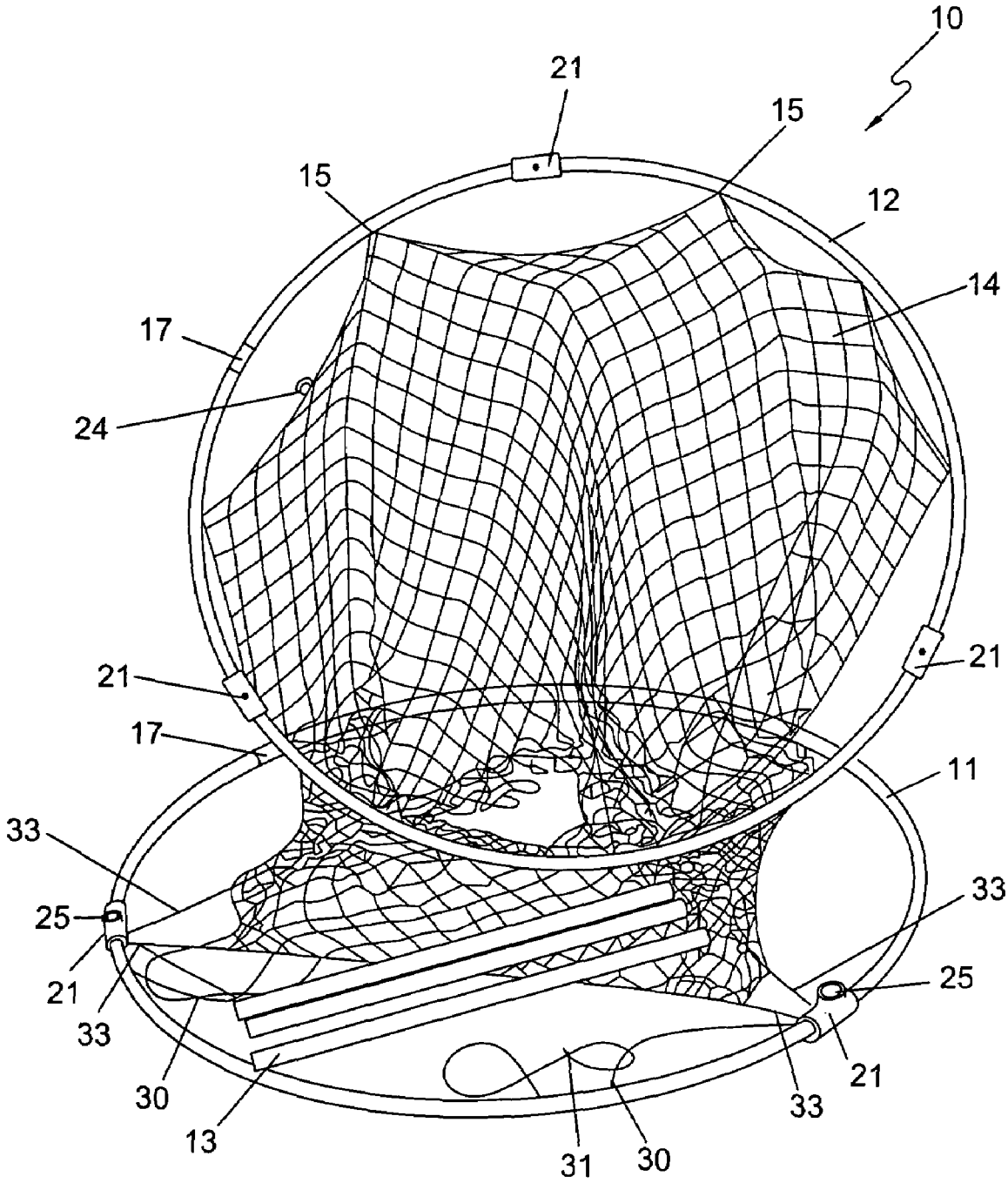
FIG. 2 is a perspective view of a game goal according to the present invention, shown partially disassembled.
Figure 5:
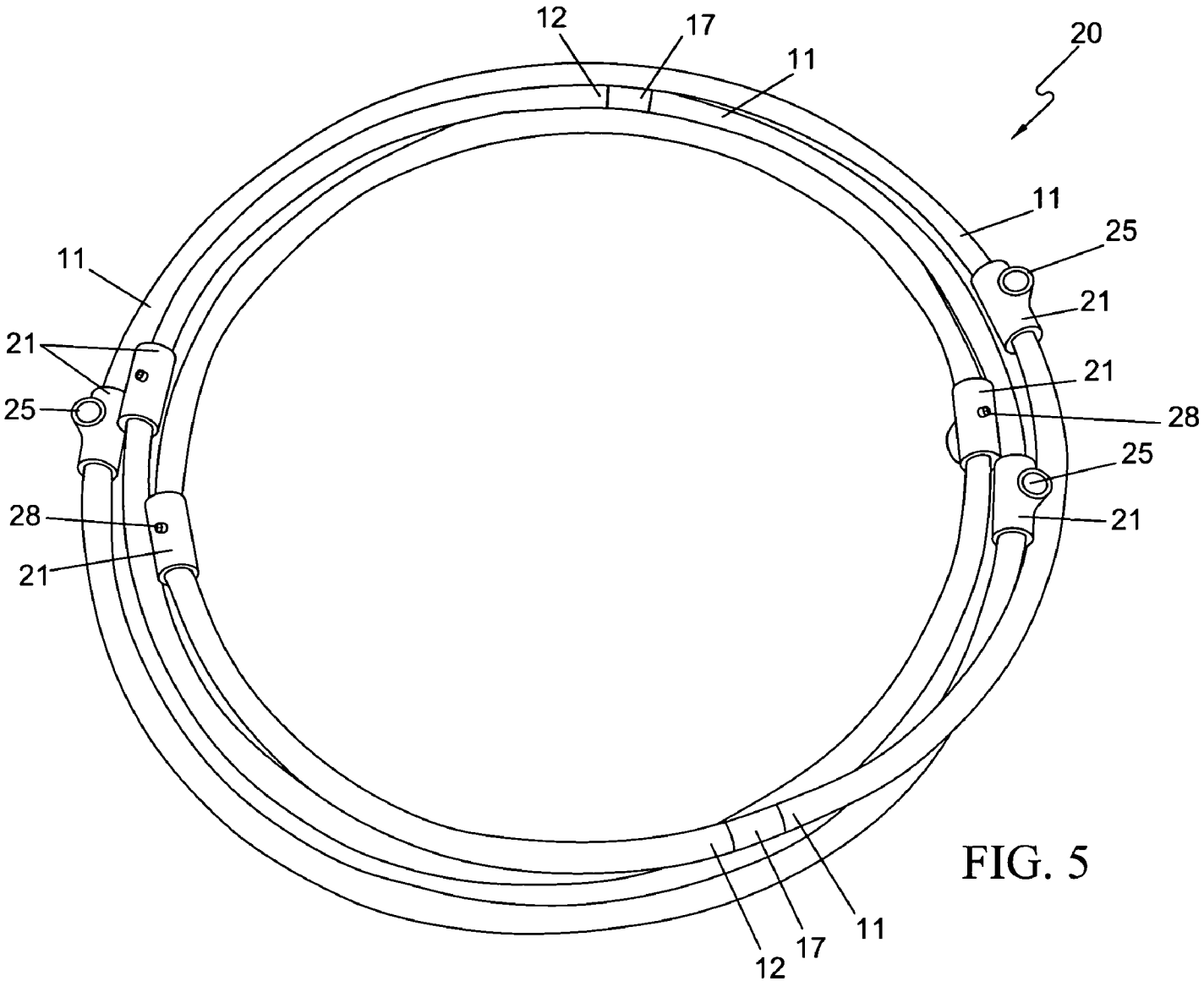
FIG. 5 is a perspective view of a hoop assembly of a game goal according to the present invention.

To erect the goal 10, the opposite ends of each of the posts 13 are inserted into spaced apart post connecting mechanisms 21 on the hoops 11, 12. The post connecting mechanisms are preferably spaced apart post connecting tees 21, which encircle the upper and lower hoops 11, 12. Of course, post-receiving ends 25 of the generally T-shaped post connecting tees 21 on the upper hoop 12 extend downwardly and the post-receiving ends 25 of the corresponding, same sized lower post connecting tees extend upwardly, as shown in FIGS. 1, 2, and 5, so that the posts can easily be inserted in, or removed from, the post connecting tees 21.

As seen in FIGS. 1, 2, 4A-C, 5, 7 and 8, each of the hoops 11, 12 comprises at least one hoop coupling 17. Each of the hoops 11, 12 can be opened at the hoop coupling 17, which is preferably a copper coupling. The hoop coupling 17 permits a user to pull each hoop 11, 12 apart for disassembly of the goal 10 into the collapsed position. The upper hoop 12 is shown in a connected, ready for use position in FIG. 4A, in a disconnected, relaxed position in FIG. 4B, and in a collapsed, disconnected position in FIG. 4C. The other, lower hoop 11 has the same appearance. The hoop coupling 17 also permits the user to assemble the goal 10 into the erect, ready for use position.

Figure 4A:
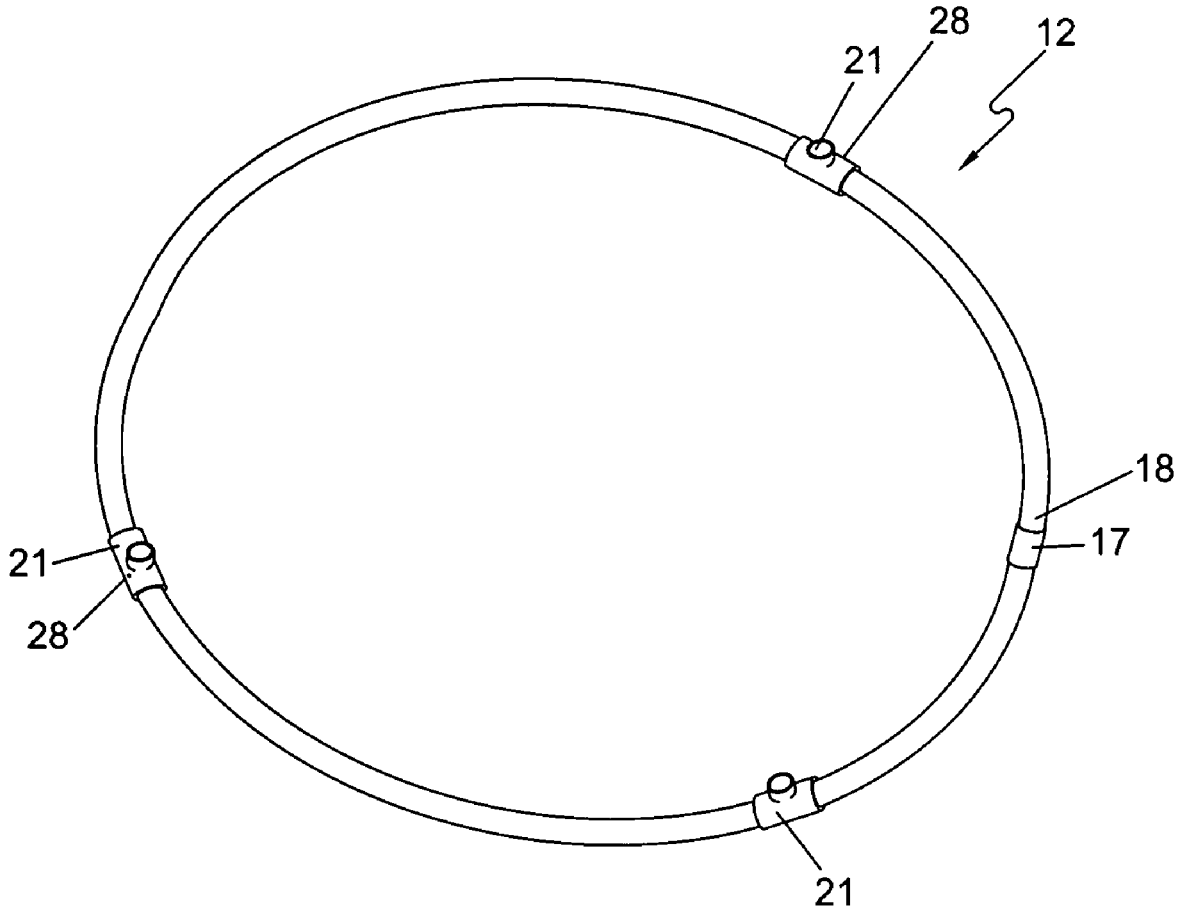
FIG. 4A is a perspective view of a hoop of a game goal according to the present invention, shown in a ready for use position.
Figure 4B:
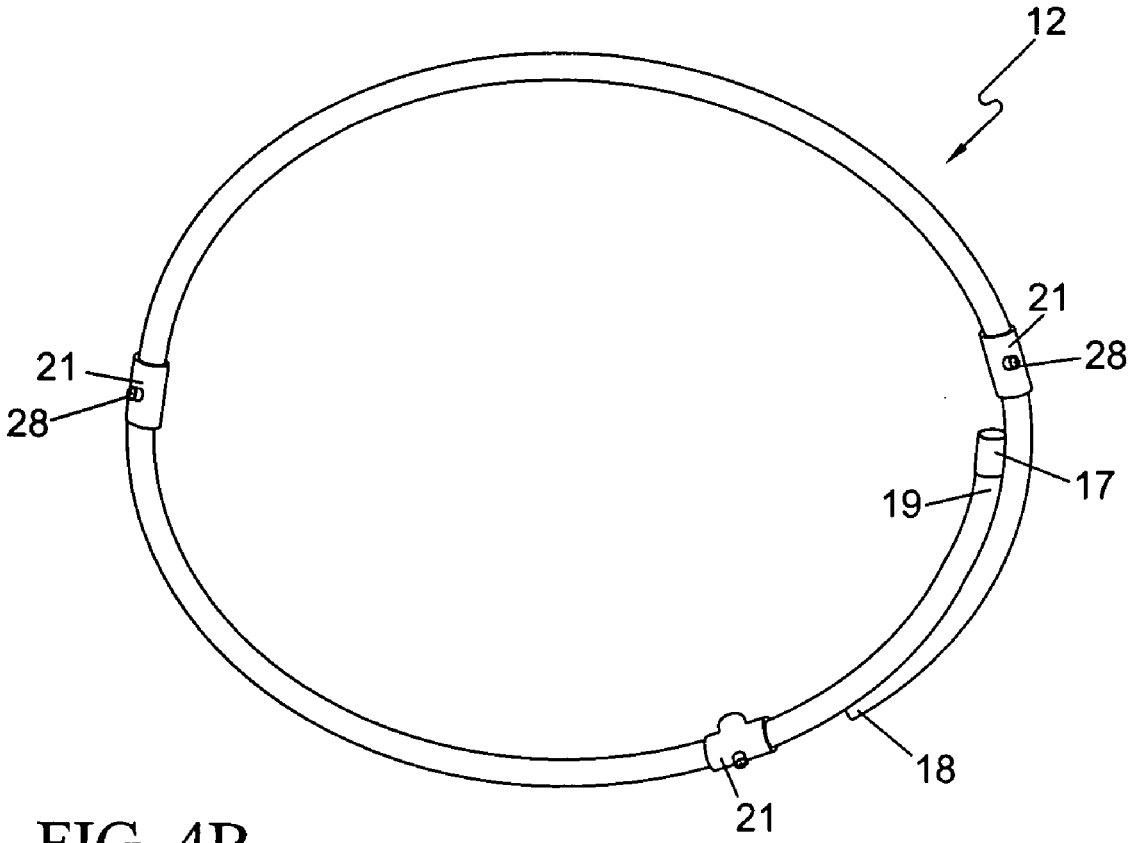
FIG. 4B is a perspective view of a hoop of a game goal according to the present invention, shown in a partially disassembled position.
Figure 4C:
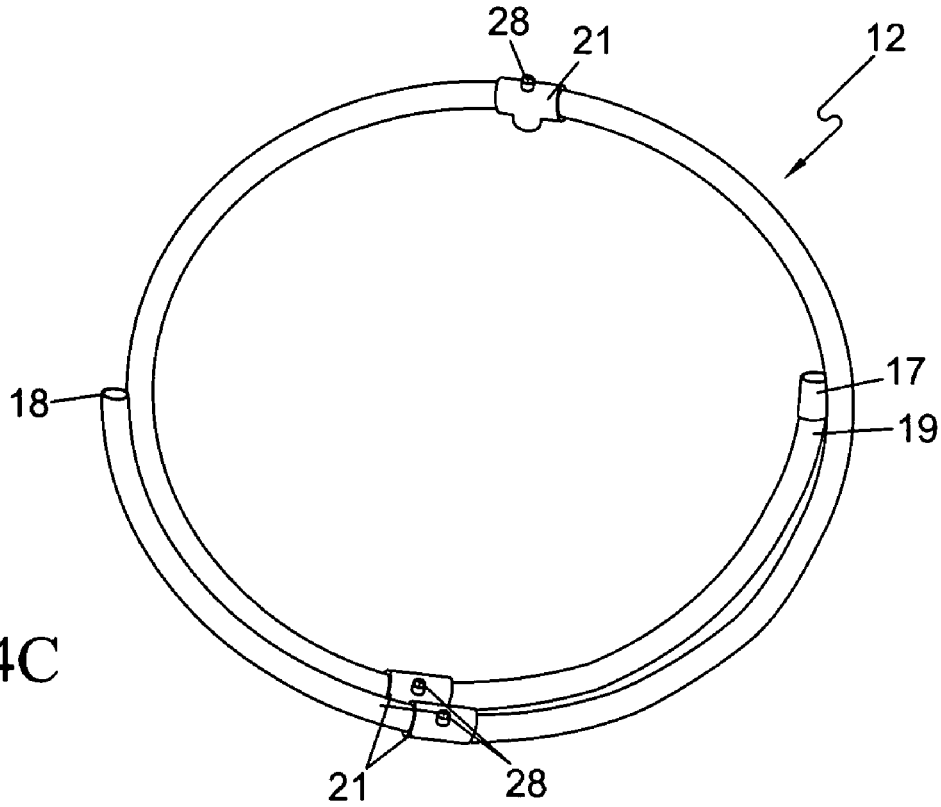
FIG. 4C is a perspective view of a hoop of a game goal according to the present invention, shown in a coiled position.

A male end 18 of the hoop 11, 12 fits into the female end of the coupling 17, the opposite end of which is preferably permanently attached to the opposite end 19 of the hoop 11, 12 (see FIGS. 4A-C). The male end 18 of each hoop 11, 12 is also insertable into the female end of the coupling 17 on the other hoop 11, 12. Surprisingly, when the male ends 18 of both hoops 11, 12 are inserted into the female couplings 17 of the opposite hoop, a coiled hoop assembly 20 is formed (see FIG. 5), forming a FIG. 8 shape. This is flattened, or pressed down by the user, into the collapsed, coiled hoop assembly shown in FIG. 7. The collapsed net 14 falls within the center of the hoops when the goal 10 is collapsed, as depicted in FIG. 7.

The hoops 11, 12 and posts 13 are preferably made of bendable polyvinyl chloride (PVC) tubing, which most preferably has a diameter of ½ to two inches. Other tube diameters are also suitable for use herein. The polyvinyl chloride may be of larger diameter for greater rigidity, if desired. Other suitable materials, such as metal, wood, or spring steel, may be used instead of polyvinyl chloride. The hoop coil of the collapsed goal helps to maintain the integrity of the preferred polyvinyl chloride hoop assembly, so the goal is less likely to lose its shape over time, even though it is exposed to weather.

Left alone, a disconnected polyvinylchloride hoop 11, 12 tends to assume the relaxed position shown in FIG. 4B. Therefore, when the user inserts the male hoop end 18 of a disconnected hoop 11, 12 into the coupling 17 of the same hoop, the resulting tension holds the hoop in position so that it does not buckle easily when, for example, it is impacted by a kicked ball. During disassembly of the goal 10, the male hoop end 18 must be pulled out of the coupling 17 with slight force in order to separate each hoop 11, 12. The disconnected, collapsed hoop shown in FIG. 4C is approximately ⅔ the size of the connected hoop as depicted in FIG. 4A, hence the collapsed hoops are easier to store. Additionally, the collapsed goal (see FIG. 7) is generally flat, which also makes it easier to store. A collapsed goal fits into, for example, a car trunk or rear seat.

Figure 3:
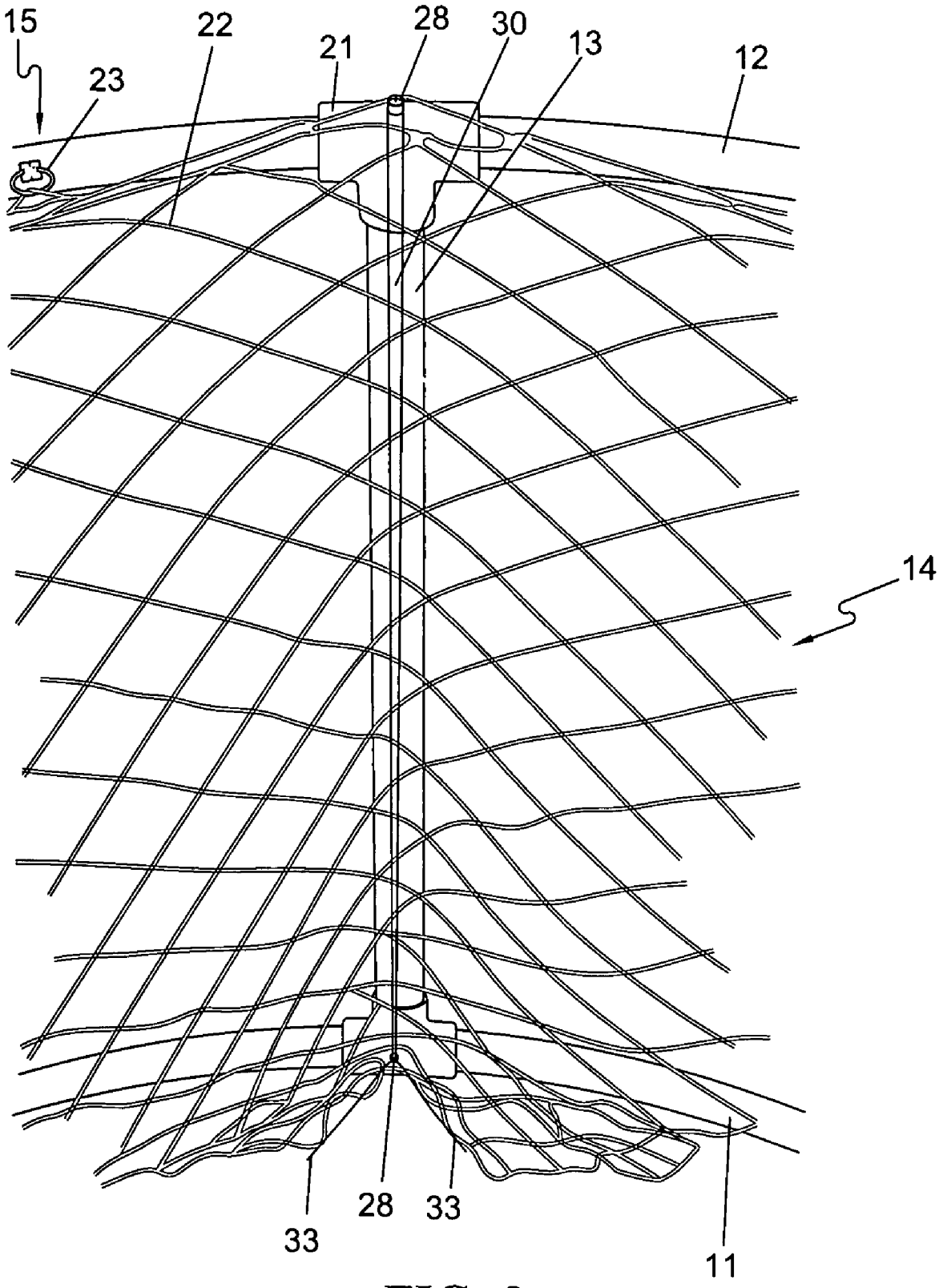
FIG. 3 is a perspective view of a portion of a game goal according to the present invention.

Referring to FIGS. 1 and 3, it has been found herein that the net 14 performs better when it hangs from the upper hoop 12 on a slant so that the apertures in the net are diamond-shaped 22, as shown in FIGS. 1 and 3, rather than hanging straight down in a conventional fashion so that rows of square-shaped apertures are seen. The net 14 of the erect goal 10 is flexible rather than taut. It has been found herein that this slant allows the net to better absorb the impact of a kicked or thrown game ball, reduces the amount of net that is required to cover the goal. faces, and makes it easier to attach and detach the net from the upper hoop 12. A flexible, strong, durable, mesh net is preferred.

The edge of the net 14 is pinned at the spaced apart net attachment points 15, preferably about six to twelve, along the upper hoop 12. Preferably, the edge of the net 14 is slidably looped through net attachment loops 23 screwed into the inside surface of the upper hoop 12, as seen in FIG. 3. Other mechanisms for attaching the net to the upper hoop at spaced apart attachment points, such as hooks, screws, bolts, or clasps, may be employed as well. The net may optionally be attached to sheath sections that are wrapped around the upper hoop (not shown). The spaced apart attachment points 15 (see FIG. 2) are advantageous in that they permit the net to stretch at the top in order to better absorb impacts from air borne game balls. Importantly, when the net 14 is hung at a slant and pinned at intervals along its edge to the upper hoop as described herein, it forms a conical rather than a cylindrical shape (see FIGS. 1 and 2). The conical, or funnel, shaped net is desirable in a game goal because it forms a pocket for receiving the ball rather than simply hanging straight down in a conventional manner. The circular-shaped top edge of the net 14 forms the edge of the generally horizontal scoring basket 27. The net 14 hangs down by gravity from the upper hoop 12 when the goal 10 is erect. The net 14 is preferably not attached along the lower hoop 12 at attachment points analogous to the multiple attachment points on the upper hoop 12. The goal net 14 is longer than it needs to be to simply touch the ground inside the lower hoop 11. The goal net 14 herein is preferably long and draped. This net assembly has been found herein to facilitate removal of the posts 13 during disassembly of the goal 10, and to allow give when the game ball impacts the net 14. When the ball impacts the goal net 14, it has been found herein that the goal net 14 slides up the post(s) 13, since the net is preferably not attached to the lower hoop, rather than causing the ball to stiffly bounce off or the goal to topple over as a taut net might.

As seen in FIGS. 1 through 3, the net attachment points 15 preferably include one tee net attachment point 28 on each upper hoop tee 21, most preferably a tee attachment screw 28 screwed partway into the inside or upper surface of the tee 21 on the upper hoop 12, and two or three fixed net attachment points 23, preferably net attachment loops 23 between each hoop tee 21 (e.g., total of nine). The tee net attachment points 28 on the three upper hoop tees 21 may be permanently attached, or not. The edge of the net 14 is preferably simply looped over the tee attachment screws 28, as seen in FIG. 3. It has been found that the weight of the net hanging down from the tee attachment screws and the tautness of the edge of the net hold the net edge in position on the tee attachment screw 28. Bolts, hooks, clasps, or other suitable net attachment mechanisms may be employed instead of screws.

It has been found herein that breakdown of the goal 10 is facilitated by having one (or, less preferably, more) detachable net attachment point 24 at the upper hoop coupling 17. The other net attachment points along the upper hoop 12 are preferably permanently attached to the upper hoop 12, though they need not be. As depicted in FIG. 2, the detachable attachment point 24 is preferably a strip of hook and loop material 24 attached at one end to the edge of the net 14. The other end of the hook and loop strip 24 is loosely fastened around the hoop coupling 17. The detachable attachment point is advantageous in that it facilitates rapid disassembly of the goal 10. Specifically, the hook and loop attachment strip 24 is detached from around the upper hoop coupling 17. Since one end of the hook and loop strip 24 is attached to the end of the net 14, the hook and loop strip falls slack on the net when it is not in use. This provides some slack in the net, so that the male end 18 of the upper hoop 12 is easy to pullout of the upper hoop coupling 17 as part of the disassembly process.

Continuing with FIGS. 2 and 3, in addition to being attached to the three upper post connecting tees 21, the net 14 is held against the three posts 13 by a detachable net holding mechanism, preferably a detachable post line 30 extending between the post connecting tees 21. on the lower and upper hoops 11, 12. The post line 30 is preferably made of cord, but elastic or other suitable materials may be employed. Preferably, the lower end of the post line 30 is fixed to a screw 28 on the post connecting tee 21 on the lower hoop 11. The post lines 30 are easy to remove in order to facilitate quick disassembly and assembly of the goal 10. To assemble the goal 10, the post line 30 is pulled up along the inside of the posts over the net once the lower and upper hoops 11, 12 and the posts 13 are in place. The upper end of the post line 30 preferably includes a post line loop 31, as shown loose in FIG. 2, which is removably looped over the net attachment screw 28 or other net attachment mechanisms on the upper post connecting tee 21. The post lines are taut, as seen in FIG. 3, so that the scoring surfaces 29 do not bag. An alternate net attachment mechanism may be used instead of a screw, such as a hook screwed into the hoop. The net attachment screw 28 is preferably screwed partway into the inside surface of the post connecting tee 21 on the lower hoop 12, so the post line loop 31 can be looped around the head of the, screw 28. Each post line 30 holds the net 14 along its corresponding post 13.

The post lines 33 are advantageous in that they help to form the three (side) scoring surfaces 29 of the goal 10, which are next to one another. When the goal 10 is erect, as shown in FIG. 1, the scoring surfaces 29 are generally vertical and substantially planar. In the open goal 10, the net 14 is rounded at the top, forming the scoring basket 27, but triangular shaped at the bottom (see FIG. 1). The triangular shape is bounded by the circle formed by the lower hoop 11, as can be seen in FIG. 1. This shape permits further scoring distinctions, i.e., where a game ball passes within the circle formed by the lower hoop 11 but does not strike the net 14 of the scoring surface 29.

Another line, called here the ground or bottom line 33, is preferably employed at the base of the free falling net 14 to hold the net relatively taut close to the ground. The bottom line 33 gathers the netting at the base of the net, which serves to absorb the impact of the thrown or kicked ball and prevent the ball from pushing underneath the goal net 14 during play. When the thrown or kicked ball impacts the net down low, the bottom line 33 allows the slightly gathered net to lift up along the posts with the impact. Since the net 14 is not attached otherwise to the lower hoop 11, the bottom line 33 is also advantageous in that it prevents the lower hoop 11 from separating from the rest of the goal when the goal 10 is in the collapsed position being stored or transported.

The bottom line or lines 33 is three approximately equal lengths of cord or other line extending from one lower hoop post connecting tee 21 to the next. The bottom line 33 is preferably permanently affixed to the attachment screws 28 or other net attachment mechanism 23 on the lower hoop post connecting tees 21, so there is no need to tighten the bottom line(s). Alternatively, the bottom line 33 is a long cord, made of elastic or another suitable material, which is looped around the post-receiving ends 25 of the post connecting tees 21 or otherwise stretched between the bases of the posts 13. The bottom line 33 is woven through the net 14, which slightly gathers the net, as seen in FIG. 1.

Figure 6:
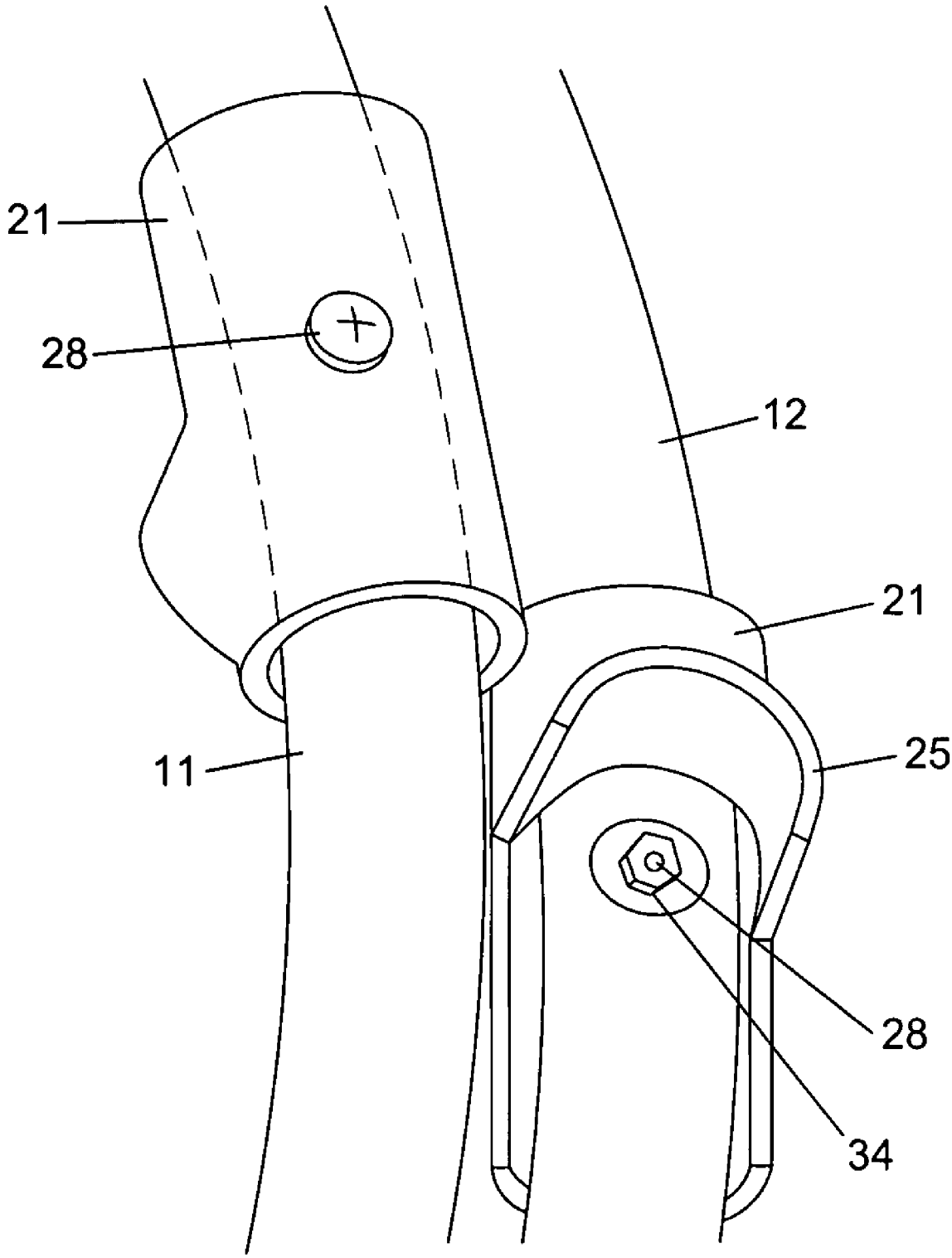
FIG. 6 is a perspective view of a portion of two post connecting tees of a game goal according to the present invention.

As shown in the cutaway post connecting tee 21 in FIG. 6, the attachment screw 28 also serves to attach each post connecting tee 21 to the upper or lower hoop 11, 12. The screw 28 in the embodiment of FIG. 6 extends through the top of the post connecting tee 21 through the hoop 11, 12. On the other side of the upper hoop 12, the end of the screw is fastened by a nut 34 and washer, as seen through the post-receiving end 25 of the tee in FIG. 6. The head of the screw 28 is not flush against the hoop, so it can serve as a point of attachment for the net 14 (upper hoop), post line 31 (either hoop), or bottom line 33 (lower hoop). Since the hoop 11, 12 is slightly curved, it preferably fits loosely within the post connecting tee 21.

To assemble the collapsed goal 10 into its open, erect position, the following steps are taken:

a) Pull the hoop assembly 20 of the goal 10 apart at the two hoop couplings 17 (see FIGS. 4A-C);

b) Insert the male end 18 of the upper or lower hoop 11, 12 into the hoop coupling 17 of the same hoop; insert the male end 18 of the other hoop 11, 12 into the hoop coupling 17 of the same hoop (see FIG. 5);

c) Place the lower hoop 11 on the. ground or other flat surface with the post-receiving ends 25 of the lower hoop post connecting tees 21 facing in an upward direction;

d) Hold the upper hoop 12 over the lower hoop 11 with the post-receiving ends 25 of the upper hoop post connecting tees 21 facing in a downward direction over the corresponding lower hoop post connecting tees 21;

e) Insert one end of each post 13 into the post-receiving end 25 of the lower post connecting tee 21 and an opposite end of the post 13 into the corresponding post-receiving end 25 of the upper hoop post connecting tee 21; repeat for each post 13 (net 14 will hang down from the upper hoop 12);

f) Pull each post line 30 taut along its corresponding post 13 and over the portion of net 14 against the post and attach the post line end loop 31 or other attachment means to the tee attachment screw 28 or other net attachment mechanism 23 on the upper hoop post connecting tee 21 at the top of the post 13 (see FIG. 3); repeat for each post line 30; and g) Attach the hook and loop strip 24 around the hoop coupling 17 on the upper hoop 12. The open goal is ready for play (see FIG. 1).

Figure 8:
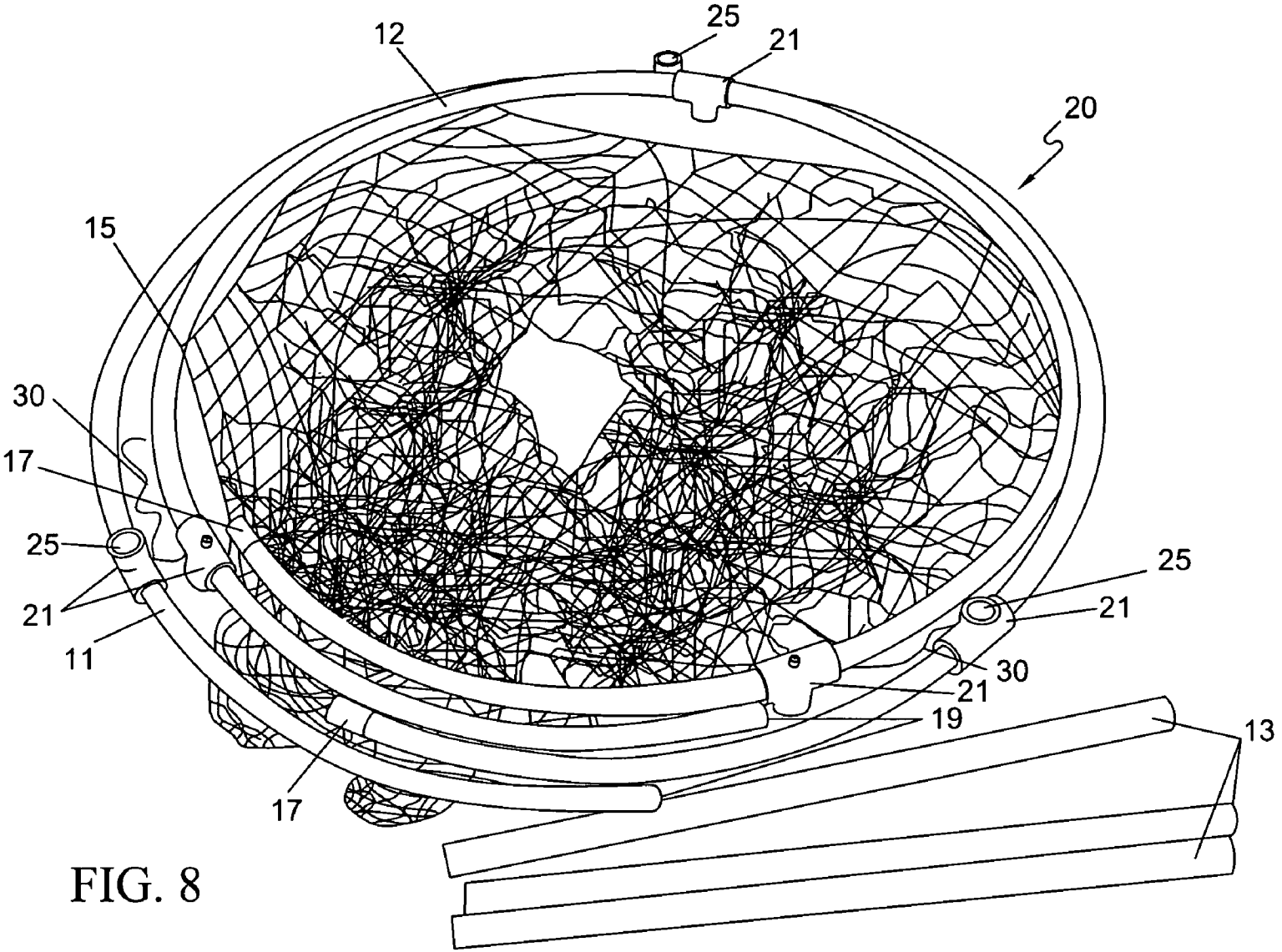
FIG. 8 is a perspective view of a game goal according to the present invention, shown in a partially collapsed, relaxed position.

To disassemble the erect goal 10 into its collapsed position, the following steps are taken. As described herein, the erect goal comprises: (1) at least two generally ring-shaped, openable, spaced apart, substantially horizontally and substantially parallel hoops 11, 12 having substantially the same diameter as one another, each of the hoops 11, 12 comprising at least one hoop coupling 17, each of the hoops 11, 12 being openable and closable at the hoop coupling 17, the hoops 11, 12 comprising at least three post connecting mechanisms 21; (2) at least three detachable, spaced apart, substantially vertical posts 13 of substantially equal length, opposite ends of each of the posts 13 being removably connectable to one of the post connecting mechanisms 21 on the hoops 11, 12; and (3) a length of substantially flexible net 14 extending between the hoops 11, 12 and between the posts 13, the net 14 being affixed to an upper one of the hoops 12, but not to the posts 13; the net 14 extending downwardly within the hoops 11, 12;

a) Detach the hook and loop strip 24 or other detachable net attachment mechanism from the hoop coupling 17 on the upper hoop 12 of the goal;

b) Detach the upper end of each post line 30 from the attachment screw 28 or other net attachment mechanism 23 on the upper hoop post connecting tee 21 at the top of each post 13; repeat for each post line 30;

c) Remove each post 13 from the post-receiving ends 25 of the upper and lower hoop post connecting tees 21 (see FIG. 2) or other post connecting mechanism;

d) Pull the upper hoop 12 apart at the upper hoop coupling 17 (can be done prior to steps 2 or 3, if desired);

e) Pull the lower hoop 11 apart at the lower hoop coupling 17 (see FIG. 8);

f) Insert the male end 18 of the upper or lower hoop 11, 12 into the hoop coupling 17 of the opposite hoop: Then insert the male end 18 of the other hoop 11, 12 into the hoop coupling 17 of the opposite hoop, forming a FIG. 8 hoop assembly 20; and g) Optionally, press down on top of the hoop assembly 20 so that it is coiled and compact. The goal is now in its collapsed position, ready for transport or storage. The net 14, which remains attached to the upper hoop 12, falls within the center of the hoop assembly 20, as seen in FIG. 7. The loose post lines 30 remain attached at one end to the attachment screw 28 or other attachment means on the post connecting tees 21 of the lower hoop 11 (see FIG. 8). The bottom line 33 remains attached to the attachment screw 28 or other attachment means on the post connecting tees 21 of the lower hoop 11 (see FIG. 2). If desired, place the three posts 13 on the hoop assembly 20 (see FIG. 7), and insert the collapsed goal into a carry bag to facilitate transport. The compact shape of the closed goal is advantageous in that, among other things, it offers cheaper shipping and easy storage, takes up less space, and is easier to carry and easier to assemble and disassemble than a standard goal.

As shown in FIG. 1, when the goal 10 is erect, three generally vertical and planar scoring surfaces 29 fall within the area defined by the two hoops 11, 12. The generally circular, horizontally oriented scoring basket 27 is adjacent to and above the generally planar scoring surfaces 29. The circumference of the scoring basket 27 is defined by the upper hoop 12. The net 14 extends down from the upper hoop 12. Each of the three generally vertical scoring surfaces 29 is bounded by two of the posts 13 on either end of the scoring surface, the bottom line 33 at the bottom of the net, and the upper hoop 12 at the top of the scoring surface 29. The net 14 defines the scoring surfaces 29 on three sides of the goal, and the scoring basket 27 at the top of the goal 10. When the goal is in use, the game ball strikes the netting and bounces off or is caught in the goal 10.

A goal 10 in the open, erect position is placed on an open field for play, with one scoring surface 29 facing directly away from the opposing goal. The other two scoring surfaces 29 are then in a generally forward- facing position. The generally forward facing scoring surfaces are accessible from a larger portion of the field, and the opposite facing, rear-facing scoring surface will be accessible from a smaller portion of the field. Together, the three scoring surfaces 29 provide 360 degrees of scoring surfaces. In the game of Socci, a goal is scored each time the ball touches the net 14 or travels inside the goal 10. In Socci, a higher number of points (two points) is awarded for striking the rear scoring surface versus the front facing scorings surfaces 29 (one point). Three points are awarded for kicking the game ball into the scoring basket 27.

From the foregoing it can be realized that the described device of the present invention may be easily and conveniently utilized as a collapsible, portable game goal. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 game goal
11 lower hoop
12 upper hoop
13 posts
14 net
15 net attachment points
16 playing surface
17 hoop coupling
18 male end of hoop
19 opposite end of hoop
20 coiled hoop assembly
21 post connecting tee
22 diamond-shaped net apertures
23 net attachment loops
24 hook and loop attachment
25 post-receiving ends of tees
27 scoring basket
28 tee attachment screw
29 scoring surfaces
30 post line
31 post line loop
33 bottom line
34 screw nut

What is claimed is:

1. A collapsible, three-dimensional game goal for use on a playing surface, comprising:

(a) at least two generally ring-shaped, openable hoops, each comprising one hoop coupling, each of the hoops being openable and closable at the hoop coupling, the hoops comprising at least three post connecting mechanisms;

(b) at least three detachable posts of substantially equal length, opposite ends of each of the posts being removably connectable to one of the post connecting mechanisms on the hoops;

(c) a length of substantially flexible net affixed at a plurality of net attachment points to an upper one of the hoops; and (d) a detachable net holding mechanism attachable to the post connecting mechanisms at the opposite ends of each post;

wherein, the goal comprises an open, erect position in which a lower one of the hoops rests on the playing surface, the upper one of the hoops being substantially parallel to and spaced apart from the lower one of the hoops, the net extending downwardly between the substantially horizontally oriented hoops and the substantially vertically oriented, spaced apart posts; the at least three posts and the net defining at least three adjacent, substantially vertical scoring surfaces; the upper one of the hoops defining the generally circular upper periphery of a scoring basket at the top of the goal, the sides of a generally triangular-shaped base of the scoring basket being formed by the scoring surfaces; and wherein the goal further comprises a collapsed position in which each of the hoops is itself open and coupled to the other one of the hoops at the hoop coupling, the coupled hoop in the collapsed goal position forming compact coils that are each substantially smaller than the hoops in the erect goal position;

and wherein the at least three post connecting mechanisms comprise at least three generally T-shaped post connecting tees wherein each post connecting tee comprising a post receiving end that in the erect goal position receives a corresponding end of one of the posts and wherein the tee attachment screw extends through a top of the corresponding post connecting tee and through one of the hoops, the tee attachment screw being fastened in the post receiving end of the corresponding post connecting tee and where the net is attached at a plurality of spaced apart net attachment points to the upper hoop, but not affixed to the at least three posts.

2. The goal according to claim 1, wherein the net hangs from the upper hoop on a slant so that a plurality of apertures in the net are diamond-shaped.

3. The goal according to claim 1, wherein the goal in the erect position comprises two of the hoops: the upper hoop and the lower hoop; and three of the posts; and the coupled hoop in the collapsed goal position forming three adjacent hoop coils, an edge of the net being looped over the tee attachment screws on the upper hoop.

4. The goal according to claim 3, wherein the detachable net holding mechanism attached to the post connecting tee is a post line attached at one end to the post connecting tee on the lower hoop, and at an opposite, detachable end to a corresponding one of the post connecting tees on the upper hoop; wherein the post line holds a portion of the net against the adjacent post when the goal is in the open, erect position, and the tee attachment screw is also a point of attachment for the post line.

5. The goal according to claim 3, wherein the net attachment points comprise a tee attachment point on each post connecting tee, at least three fixed net attachment points on the upper hoop, each fixed net attachment point being between the post connecting tees, and at least one detachable net attachment point corresponding to the hoop coupling.

6. The goal according to claim 1, wherein the net remains attached to the upper one of the hoops, but not to the lower one of the hoops, in both the collapsed and the open, erect positions; and wherein the compact coils of the collapsed goal position are each about ⅔ the size of the hoops in their connected position.

7. The goal according to claim 5, wherein the fixed net attachment points are spaced apart net attachment loops permanently affixed at one end portion to the upper hoop, an edge of the net being slidably looped through an opposite end portion of each of the net attachment loops.

8. The goal according to claim 5, wherein the detachable net attachment point is a strip of hook and loop material attached to the net and attachable around the upper hoop, a vertical length of the net being greater than a height of the goal in the erect position.

9. The goal according to claim 1, wherein each scoring surface faces out in a different direction from the scoring basket, the scoring basket extending down to the playing surface.

10. The goal according to claim 1, further comprising a bottom line extending between three of the post connecting tees on the lower hoop, the bottom line being woven through a plurality of apertures of a bottom portion of the net, the tee attachment screw on each post connecting tee on the lower hoop being a point of attachment for the bottom line.

11. The goal according to claim 3, wherein the lower hoop comprises a male end that fits into a corresponding female end of the hoop coupling of the upper hoop and the upper hoop comprises a male end that fits into a corresponding female end of the hoop coupling of the lower hoop in the collapsed goal position.

12. The goal according to claim 10, wherein the bottom line is affixed to a tee attachment screw on each of the three post connecting tees, the bottom line being generally taut and generally forming the triangular shape at the base of the net when the goal is in the erect position.

13. A method of disassembling the three-dimensional game goal of claim 1, the method comprising the steps of:

a) Detaching a detachable net attachment mechanism from a hoop coupling on an upper hoop of the goal; the goal comprising: (1) at least two generally ring-shaped, openable, spaced apart, substantially horizontally and substantially parallel hoops having substantially the same diameter as one another, each of the hoops comprising at least one hoop coupling, each of the hoops being openable and closable at the hoop coupling, the hoops comprising at least three post connecting mechanisms; (2) at least three detachable, spaced apart, substantially vertical posts of substantially equal length, opposite ends of each of the posts being removably connectable to one of the post connecting mechanisms on the hoops; (3) a length of substantially flexible net extending between the hoops and between the posts, the net being affixed to an upper one of the hoops, but not to the posts; the net extending downwardly within the hoops; and (d) a detachable net holding mechanism attachable to the post connecting mechanisms at the opposite ends of each post;

b) Detaching an upper end of each of three post lines from a net attachment mechanism on an upper hoop post connecting mechanism for each post of the goal;

c) Removing each post from the upper and lower hoop post connecting mechanisms of the goal;

d) Pulling the upper hoop of the goal apart at the upper hoop coupling; and e) Pulling the lower hoop of the goal apart at the lower hoop coupling.

14. The method according to claim 13, wherein step d) precedes steps b) or c).

15. The method according to claim 13, further comprising the step of: f) Connecting one end of the upper or lower hoop into the hoop coupling of the opposite hoop; connecting one end of the other hoop into the hoop coupling of the opposite hoop.

16. A method of erecting the three-dimensional game goal of claim 1, the method comprising the steps of:

a) Pulling a hoop assembly of the collapsed goal apart at two hoop couplings of the goal; the goal comprising: (1) at least two generally ring-shaped, openable hoops having substantially the same diameter as one another, each of the hoops comprising at least one hoop coupling, each of the hoops being openable and closable at the hoop coupling, the hoops comprising at least three post connecting mechanisms; (2) at least three detachable posts of substantially equal length, opposite ends of each of the posts being removably connectable to one of the post connecting mechanisms on the hoops; (3) a length of substantially flexible net extending between the hoops and between the posts, the net being affixed to an upper one of the hoops, but not to the posts; and (d) a detachable net holding mechanism attachable to the post connecting mechanisms at the opposite ends of each post;

b) Connecting an end of the upper or lower hoop into the hoop coupling of the same hoop; connecting an end of the other hoop into the hoop coupling of the same hoop;

c) Placing the lower hoop on a generally flat surface with the lower hoop post connecting mechanisms facing in an upward direction;

d) Holding the upper hoop 12 over the lower hoop 11 with upper hoop post connecting mechanisms facing in a downward direction over the corresponding lower hoop post connecting mechanisms; and e) Inserting one end of each post into the lower post connecting mechanism and an opposite end of the post into the corresponding upper hoop post connecting mechanism; repeat for each post.

17. The method according to claim 16, further comprising the step of: f) Pulling a post line taut along each corresponding post and over a portion of net against the post and attaching a detachable end of the post line to the net attachment mechanism on the upper hoop post connecting mechanism at the top of the post; and repeat for each post line.

18. The method according to claim 17, further comprising the step of: g) Attaching the hook and loop strip around the hoop coupling on the upper hoop.

* * * * *